US007405548B2

(12) United States Patent
Alihodzic et al.

(10) Patent No.: US 7,405,548 B2
(45) Date of Patent: Jul. 29, 2008

(54) CIRCUIT FOR GENERATING A SUPPLY VOLTAGE

(75) Inventors: Admir Alihodzic, Graz (AU); Thomas Jean Ludovic Baglin, Rueil (FR)

(73) Assignee: Infineon Technologies AG (DE)

( * ) Notice: Subject to any disclaimer, the term of this patent is extended or adjusted under 35 U.S.C. 154(b) by 47 days.

(21) Appl. No.: 11/155,321

(22) Filed: Jun. 16, 2005

(65) Prior Publication Data

US 2005/0264960 A1 Dec. 1, 2005

Related U.S. Application Data

(63) Continuation of application No. PCT/EP03/13707, filed on Dec. 4, 2003.

(30) Foreign Application Priority Data

Dec. 17, 2002 (EP) ..... 02028082

(51) Int. Cl.
*G05F 1/563* (2006.01)

(52) U.S. Cl. ..... 323/282

(58) Field of Classification Search ..... 323/273, 323/281, 282, 283, 284, 351
See application file for complete search history.

(56) References Cited

U.S. PATENT DOCUMENTS

| | | | | |
|---|---|---|---|---|
| 5,563,498 | A | 10/1996 | Candy | |
| 6,583,610 | B2 * | 6/2003 | Groom et al. | 323/288 |
| 6,788,035 | B2 * | 9/2004 | Bassett et al. | 323/272 |
| 7,053,594 | B2 * | 5/2006 | Sutardja et al. | 323/283 |
| 2002/0043963 | A1 * | 4/2002 | Malik et al. | 323/276 |
| 2002/0089317 | A1 | 7/2002 | Khouri et al. | |

FOREIGN PATENT DOCUMENTS

EP 0 260 474 A1 3/1988

* cited by examiner

*Primary Examiner*—Adolf Berhane
(74) *Attorney, Agent, or Firm*—Dickstein, Shapiro, LLP.

(57) ABSTRACT

Circuit for generating a supply voltage having a voltage input connected to a voltage regulator that generates a first supply voltage and to a low-noise voltage regulator that generates a low-noise supply voltage. A control unit determines which of the two supply voltages is switched to a supply voltage output of the circuit.

20 Claims, 2 Drawing Sheets

CIRCUIT FOR GENERATING A SUPPLY VOLTAGE

CROSS-REFERENCE TO RELATED APPLICATION

This application is a continuation of International Patent Application Ser. No. PCT/EP2003/013707, filed Dec. 4, 2003, which published in German on Jul. 1, 2004 as WO 2004/055613, and is incorporated herein by reference in its entirety.

FIELD OF THE INVENTION

The invention relates to a circuit for generating a supply voltage which may serve for example for supplying voltage to a chip.

BACKGROUND OF THE INVENTION

In some chips it is necessary that the external supply voltage generated by an external voltage source must first be regulated in order then subsequently to be able to be used for the chip core. The requisite voltage regulators require a reference voltage, which is generally generated in the chip itself. Two noise paths can occur in this case. The first noise path relates to the path from the external voltage source to the reference voltage source and from the reference voltage source to the voltage supply for the chip core. The second noise path relates to the path from the external voltage source to the voltage supply for the chip core. Taking account of the noise paths is of importance in particular because the reference voltage regulator that generates the reference voltage generally has poorer noise suppression than the supply voltage regulator in the chip core. If the noise in the reference voltage source is too high, the latter may, under certain circumstances, even be destroyed.

The prior art discloses a circuit for generating a supply voltage such as is shown in FIG. 1. A voltage regulator 1, having no particular precautions for noise suppression, is connected, on the input side, to a voltage input IN, at which an external supply voltage EXTVDD is present. The voltage regulator 1 generates a reference supply voltage REFVDD at its output, which voltage is passed to a reference voltage source 2. The reference voltage source 2 generates therefrom a reference voltage VREF, which is subsequently fed to a low-noise voltage regulator 3 via the first input 3.1 thereof. The external supply voltage EXTVDD applied to the voltage input IN is present at the second input 3.2 of the low-noise voltage regulator 3. The low-noise voltage regulator 3 then generates a supply voltage VDD, which can be tapped off at the output 3.4 of the low-noise voltage regulator 3. If the low-noise voltage regulator 3 additionally requires a regulated voltage supply, the latter can be made available to it as reference supply voltage REFVDD via the input 3.3, which is indicated by the dotted line in FIG. 1.

An embodiment of a circuit for a voltage supply as shown in FIG. 1 has the disadvantage, however, that the noise of the reference voltage supply is suppressed only to a limited extent, which has the effect that the supply voltage VDD at the output of the circuit may be noisy. The circuit for supplying voltage for the chip core as shown in FIG. 1 therefore has only limited noise suppression.

A further embodiment of a circuit for generating a supply voltage is shown from the prior art, said embodiment being shown in FIG. 2. In the same way as in FIG. 1, the external supply voltage EXTVDD is applied to the input IN of the circuit. The circuit in FIG. 2 differs from the circuit shown in FIG. 1 by the fact that the noisy voltage regulator 1 used in FIG. 1 is replaced by a low-noise voltage regulator 6 and also a simple reference voltage regulator 4, having no particular noise suppression. In this case, the second low-noise voltage regulator 6 is connected to the voltage input IN via its input 6.2. A first reference voltage VREF1 is formed from the external supply voltage EXTVDD with the aid of the voltage regulator 4, and is present at the input 6.1 of the low-noise voltage regulator 6.

In the case of the embodiment shown in FIG. 2, the reference voltage REFVDD is generated by means of the low-noise second voltage regulator 6. This embodiment has the following disadvantages, however. The additional second low-noise voltage regulator 6 requires more space on the chip. Further disadvantages are that the embodiment shown in FIG. 2 consumes more current and the switch-on duration is greater than in the case of the embodiment shown in FIG. 1. If the low-noise voltage regulator itself needs a regulated supply voltage, a further voltage regulator is required, which additionally takes up chip area.

SUMMARY OF THE INVENTION

It is an object of the invention to specify a circuit for generating a supply voltage in which, on the one hand, the noise component in the supply voltage is as small as possible, and, on the other hand, the area required for the circuit is likewise minimized.

It is additionally advantageous if the supply voltage is available as rapidly as possible, that is to say that the switch-on duration is as short as possible.

The circuit according to the invention for generating a supply voltage has a voltage input connected to a voltage regulator that generates a first supply voltage and a low-noise voltage regulator that generates a low-noise supply voltage. A control unit determines which of the two supply voltages is switched to a supply voltage output of the circuit.

In one embodiment of the invention, a first controllable switch is provided, via which the voltage regulator can be connected to the supply voltage output. A second controllable switch is additionally provided, via which the low-noise voltage regulator can be connected to the supply voltage output. The two controllable switches can be controlled by means of the control unit. This achieves, in a simple manner, a changeover between the first supply voltage, which may be noisy but is available rapidly, and the low-noise supply voltage, which, however, is not available until somewhat later.

BRIEF DESCRIPTION OF THE DRAWINGS

The invention is explained in more detail below with reference to five figures.

DETAILED DESCRIPTION OF PREFERRED EMBODIMENTS OF THE INVENTION

Figure 1:
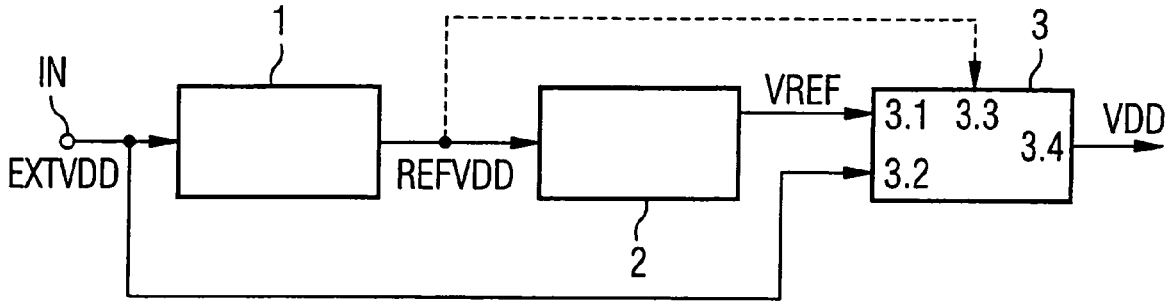
FIG 1 PRIOR ART
FIG. 1 shows a circuit for generating a supply voltage in accordance with the prior art.
Figure 2:
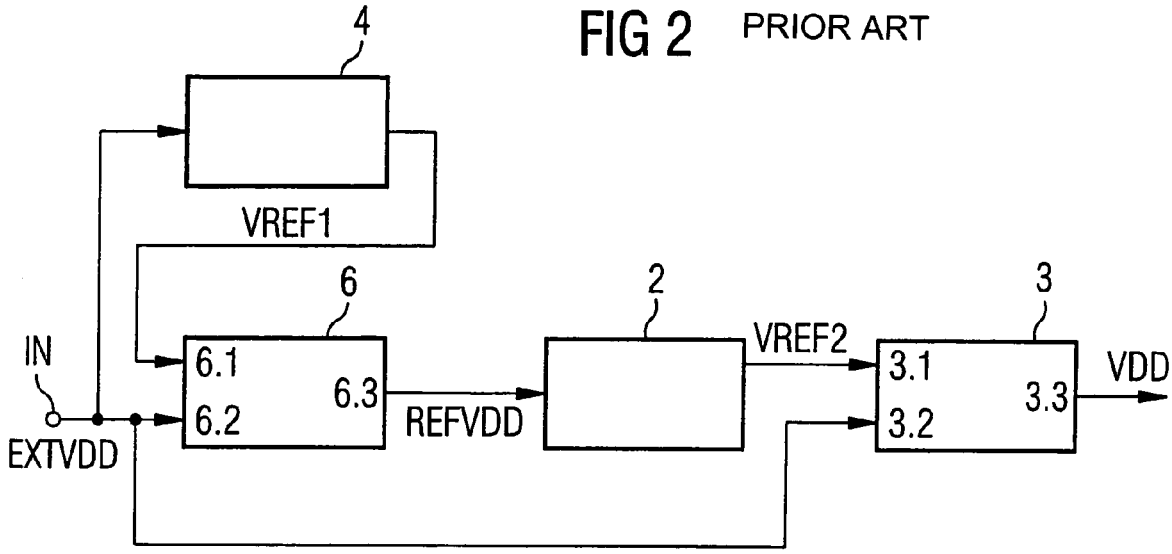
FIG 2 PRIOR ART
FIG. 2 shows a second embodiment of a circuit for generating a supply voltage in accordance with the prior art.

FIGS. 1 and 2 will not be discussed any further below since they have already been elucidated in the introduction to the description. Therefore, reference is made to the introduction to the description at this juncture.

Figure 3:
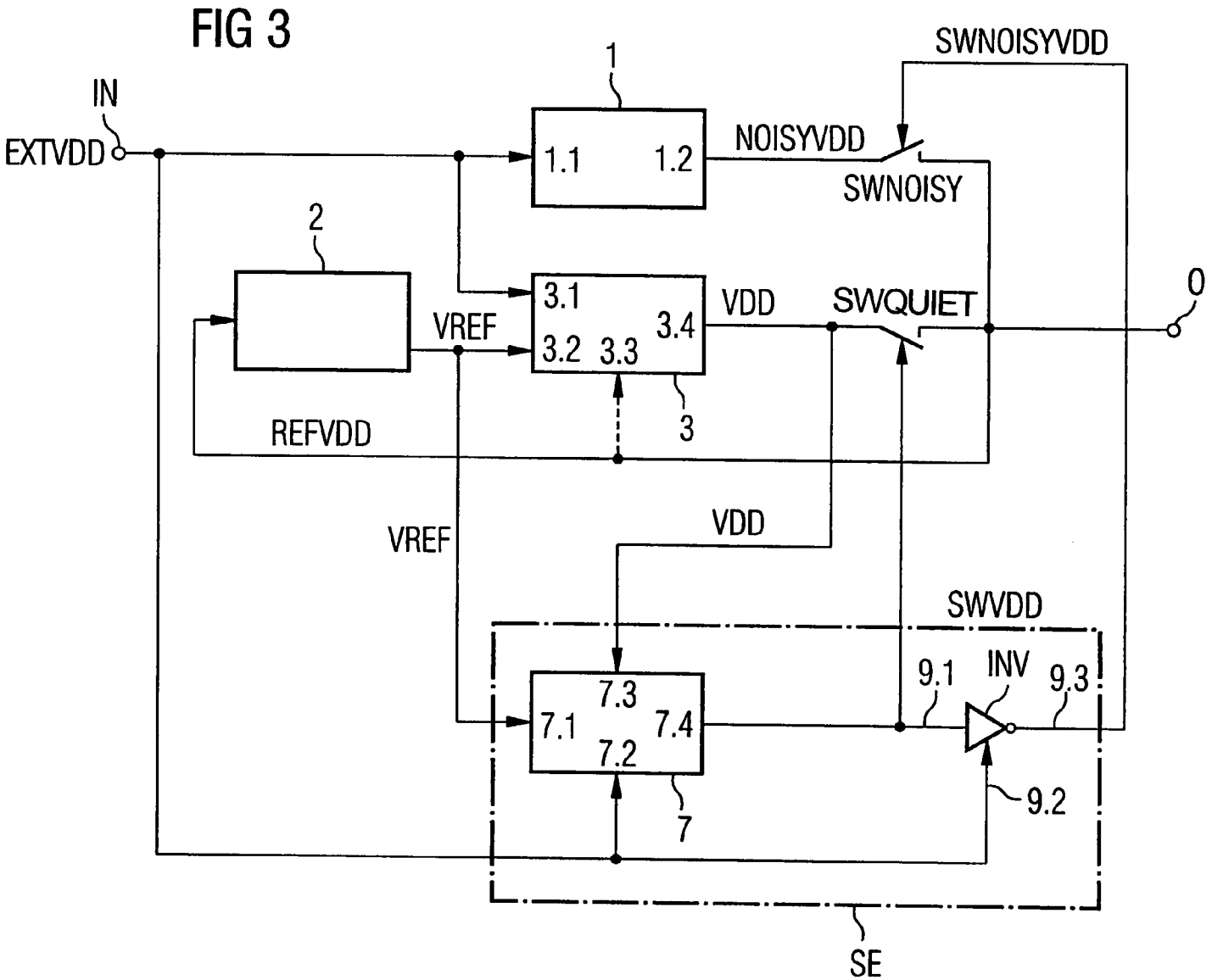
FIG. 3 shows a circuit for generating a supply voltage in accordance with the invention.

In the case of the embodiment of the circuit according to the invention for generating a supply voltage as shown in FIG. 3, an external supply voltage EXTVDD is applied to the voltage input IN, which external supply voltage is present firstly at the input 1.1 of a voltage amplifier 1 and also at the input 3.1 of a low-noise voltage amplifier 3. The voltage amplifier 1 is connected to the output O of the circuit via a controllable switch SWNOISY on the output side, that is to say via its output 1.2. The output 3.4 of the low-noise voltage amplifier 3 is likewise connected to the output O of the circuit via a further controllable switch SWQUIET. The reference supply voltage REFVDD can be tapped off at the output O of the circuit, which reference supply voltage is equal either to the non-noise-compensated supply voltage NOISYVDD or to the low-noise supply voltage VDD. The two controllable switches SWNOISY and SWQUIET are controlled by means of the two control voltages SWNOISYVDD and SWVDD, respectively, which originate from a control unit SE. The control unit SE generates the two control voltages SWVDD and SWNOISYVDD in a manner dependent on the supply voltage VDD, which is generated by the low-noise voltage regulator 3 and is passed to the input 7.3 of a decision unit 7, in a manner dependent on a reference voltage VREF, which is passed to the input 7.1 of the decision unit 7, and in a manner dependent on the external voltage EXTVDD, which is passed to the input 7.2 of the decision unit 7. The control voltage SWNOISYVDD can be tapped off at the output 9.3 of an inverter INV and forms the inverted signal with respect to the signal with the voltage SWVDD present at the input 9.1 of the inverter INV. With the aid of a reference voltage source 2, the reference voltage VREF is formed from the reference supply voltage REFVDD and passed to the input 3.2 of the low-noise voltage regulator 3. If the low-noise voltage regulator 3 requires an additional regulated supply voltage for operation, the input 3.3 is provided at the low-noise voltage regulator 3, which can be connected to the reference voltage REFVDD as required, this being represented by the dotted line.

The functioning of the circuit shown in FIG. 3 is described below. Upon switch-on, the decision unit 7, also referred to as a switch-on detector, generates at its output 7.4 a control signal with the control voltage SWVDD, which is equal to the external supply voltage EXTVDD. A control voltage SWNOISYVDD equal to zero is then present at the output 9.3 of the inverter INV. This has the consequence that the controllable switch SWNOISY, since the control voltage SWNOISYVDD at the control input of the switch SWNOISY is equal to zero, is switched on, that is to say becomes conducting. By contrast, the switch SWQUIET is switched off, that is to say becomes nonconducting, on account of the control voltage SWVDD, which forms the control voltage for the switch SWQUIET. In this state, the reference supply voltage REFVDD is equal to the non-noise-compensated voltage NOISYVDD present at the output 1.2 of the voltage regulator 1. Since the external supply voltage EXTVDD is in the high state, the non-noise-compensated voltage NOISYVDD will rise from the value zero to a specific regulated value. During this time, that is to say the switch-on time duration, the non-noise-compensated voltage NOISYVDD is the reference supply voltage REFVDD of the circuit for voltage supply. At the output of the reference voltage source 2, the reference voltage VREF likewise rises from the value zero to the value of the reference voltage. The low-noise voltage regulator 3 is then able to correctly regulate the low-noise voltage VDD, so that the low-noise voltage VDD at the output 3.4 of the low-noise voltage regulator 3 rises from the value zero to the regulated value. Once the switch-on operation has ended, the switch-on detector 7 switches the voltage SWVDD to the value zero via its output 7.4, so that the controllable switch SWQUIET becomes conducting. Since the signal SWNOISYVDD is now equal to the external supply voltage EXTVDD, the controllable switch SWNOISY is brought to the nonconducting state. The reference voltage source 2 is now supplied via the low-noise voltage regulator 3 and the low-noise voltage regulator 3 uses the reference voltage VREF generated by the reference voltage source 2.

During the switch-on phase, control voltage SWVDD at the output 7.4 of the switch-on detector 7 is equal to the external supply voltage EXTVDD. As soon as the switch-on operation has ended, the voltage SWVDD at the output 7.4 falls to the value zero. In order to determine the end of the switch-on operation, various criteria may be used. These may be for example a time constant, the magnitude of the voltage VDD or else the magnitude of the voltage difference between the two voltages VDD and VREF.

The two controllable switches SWNOISY and SWQUIET are preferably designed as transistors and operate in the same way. The functioning of the controllable switch SWQUIET is described below.

The controllable switch SWQUIET is conducting if the control voltage SWVDD is less than the difference between the voltages VDD−Vt or the control voltage SWVDD is less than the difference between the voltages REFVDD−Vt. In this case, the voltage REFVDD at the output of the controllable switch SWQUIET is equal to the voltage VDD. If the control voltage SWVDD is greater than the difference between VDD−Vt and greater than the difference between REFVDD−Vt, the controllable switch SWQUIET becomes nonconducting and the two voltages VDD and REFVDD are independent of one another. The voltage Vt is a constant voltage.

The inverter INV generates a signal with the voltage SWNOISYVDD equal to zero at its output 9.3 if the voltage SWVDD at its input 9.1 is equal to the supply voltage EXTVDD. If the voltage at the input 9.1 of the inverter INV is equal to zero, the inverter INV generates a voltage SWNOISYVDD equal to the external supply voltage EXTVDD.

Figure 4:
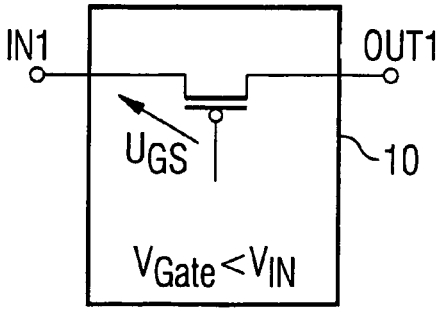
FIG. 4 shows an embodiment for a voltage regulator such as can be used in the case of the circuit according to the invention.

By way of example, the P-channel MOS transistor shown in FIG. 4 may be used as voltage amplifier 1. The supply voltage can be made available rapidly during the switch on phase. In principle, a PMOS voltage regulator intrinsically has an unfavorable PSRR (Power Supply Rejection Ratio). This can be recognised on the basis of the following example. If the voltage at the input IN1 falls very rapidly by one volt, the gate voltage has to reduce the PMOS gate voltage by one volt very rapidly in order to keep the output voltage at the output OUT1 constant. However, since the circuit reduces the gate voltage only with a certain delay, the alteration by one volt at the input IN1 can at least in part also be ascertained at the output OUT1. Therefore, a certain noise will always be discernible at the output OUT1. The PMOS regulator also has a poor response behavior in the event of an alternation in the load at the output OUT1. If the load at the output OUT1 increases very rapidly, the voltage at the input IN1 remaining constant, the regulator circuit has to reduce the gate voltage. However, in this case as well, the PMOS transistor 10 only reacts after a certain time duration, which has the effect that the voltage at the output OUT1 decreases while the gate voltage still remains constant. The gate-source voltage decreases, which has the effect that the output voltage at the output OUT1 decreases further. On account of these properties, the PMOS voltage regulator is suitable for the voltage regulator 1.

Figure 5:
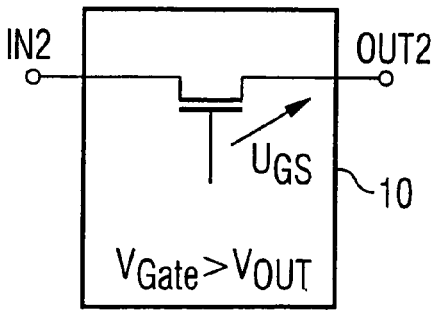
FIG. 5 shows an embodiment for a low-noise voltage regulator such as can be used in the case of the circuit according to the invention.

The N-channel MOS transistor 11 shown in FIG. 5 can be used for the low-noise voltage regulator 3 in the case of the circuit according to the invention. A low noise supply voltage can thus be made available at the output of the circuit.

By comparison with the PMOS transistor 10 shown in FIG. 4, the NMOS transistor 11 has the advantage that it has a good PSRR. If the voltage at the input IN2 falls by one volt very rapidly, the NMOS gate voltage has to be kept constant in order to keep the voltage at the output OUT2 constant, which is actually achieved by means of the NMOS voltage regulator. The NMOS regulator also has a better behavior with regard to load changes at the output OUT2 and is the case with the PMOS transistor shown in FIG. 4. Assuming that the load at the output OUT2 increases very rapidly while the voltage at the input IN2 remains constant, then the regulator circuit has to increase the gate voltage in order to keep the voltage at the output OUT2 constant. However, since the voltage regulator only reacts after a certain time duration, the voltage at the output OUT2 decreases while the gate voltage remains constant. The gate-source voltage UGS increases, which has the consequence that the post-oscillation of the voltage at the output OUT2 is limited.

The PMOS transistor shown in FIG. 4 is significantly simpler to implement on a chip and the costs are significantly lower than in the case of the NMOS transistor shown in FIG. 5. In the case of a PMOS transistor, the gate voltage remains between the voltage present at the input IN1 and zero volts. In the case of an NMOS transistor, the gate voltage may exceed the voltage present at the input IN2, so that a charge pump is required.

The control unit SE may be designed such that one of the two supply voltages (low-noise supply voltage VVD and non-noise compensated supply voltage NOISYVDD) is switched to the supply voltage output O of the circuit depending on the low noise supply voltage VDD. What is thereby achieved is that specific criteria which can be derived from the low noise supply voltage VDD are used to determine when a changeover is made between the non-noise compensated supply voltage NOISYVDD and the low noise supply voltage VDD.

The control unit SE may alternatively be designed such that one of the two supply voltages is switched to the supply voltage output O of the circuit depending on a reference voltage VREF. That is to say that it is only if the reference voltage VREF satisfies specific criteria that a changeover is made from the non-noise compensated supply voltage NOISYVDD to the low noise supply voltage VDD.

The control unit SE may alternatively be designed such that one of the two supply voltages is switched to the supply voltage output O of the circuit depending on the supply voltage present at the voltage input. Consequently, the point in time of the changeover from the non-noise compensated supply voltage NOISYVDD to the low noise supply voltage VDD is determined on the basis of specific criteria which result from the external supply voltage EXTVDD.

What is claimed is:

1. A circuit for generating a supply voltage, comprising:

a voltage input connected to a voltage regulator that generates a first supply voltage and to a low-noise voltage regulator that generates a low-noise supply voltage;

a control unit that determines which one of the two supply voltages is switched to a supply voltage output of the circuit; and a switching unit controlled by the control unit wherein only one of said two supply voltages is switched to the supply voltage output of the circuit;

wherein the switching unit further comprises:

a first controllable switch via which the voltage regulator can be connected to the supply voltage output; and a second controllable switch via which the low-noise voltage regulator can be connected to the supply voltage output, wherein the control unit controls the two controllable switches.

2. The circuit as claimed in claim 1, wherein the first and the second controllable switch are transistors.

3. The circuit as claimed in claim 1, wherein the controller unit has a first control output and a second control output, wherein the second control output is formed by an inversion of the first control output.

4. The circuit as claimed in claim 1, wherein the control unit is designed such that one of the two supply voltages is switched to the supply voltage output of the circuit depending on the low-noise supply voltage.

5. The circuit as claimed in claim 1, wherein the control unit is designed such that one of the two supply voltages is switched to the supply voltage output of the circuit depending on a reference voltage.

6. The circuit as claimed in claim 1, wherein the control unit is designed such that one of the two supply voltages is switched to the supply voltage output of the circuit depending on a supply voltage present at the voltage input.

7. The circuit as claimed in claim 5, further comprising a unit that generates the reference voltage and is connected upstream of the low-noise voltage regulator.

8. The circuit as claimed in claim 1, wherein the low-noise voltage regulator has an input for a regulated supply voltage, which is connected to the output of the low-noise voltage regulator via the first controllable switch.

9. The circuit as claimed in claim 1, wherein the voltage regulator has a P-channel MOS transistor.

10. The circuit as claimed in claim 1, wherein the low-noise voltage regulator has an N-channel MOS transistor.

11. A circuit for generating a supply voltage, comprising:

a voltage input connected to a voltage regulating means for generating a first supply voltage and to a low noise voltage regulating means for generating a low noise supply voltage;

a control means for determining which one of the two supply voltages is switched to a supply voltage output of the circuit; and a switching unit controlled by the control unit wherein only one of said two supply voltages is switched to the supply voltage output of the circuit;

wherein the switching unit a first controllable switching means via which the voltage regulating means can be connected to the supply voltage output; and a second controllable switching means via which the low noise voltage regulating means can be connected to the supply voltage output, wherein the control means controls the two controllable switching means.

12. The circuit as claimed in claim 11, wherein the first and the second controllable switching means are transistors.

13. The circuit as claimed in claim 11, wherein the control means has a first control output and a second control output, wherein the second control output is formed by an inversion of the first control output.

14. The circuit as claimed in claim 11, wherein the control means is designed such that one of the two supply voltages is switched to the supply voltage output of the circuit depending on the low noise supply voltage.

15. The circuit as claimed in claim 11, wherein the control means is designed such that one of the two supply voltages is switched to the supply voltage output of the circuit depending on a reference voltage.

16. The circuit as claimed in claim 11, wherein the control means is designed such that one of the two supply voltages is switched to the supply voltage output of the circuit depending on a supply voltage present at the voltage input.

17. The circuit as claimed in claim 15, further comprising a means for generating the reference voltage connected upstream of the low noise voltage regulating means.

18. The circuit as claimed in claim 11, wherein the low noise voltage regulating means has an input for a regulated supply voltage, which is connected to the output of the low noise voltage regulating means via the first controllable switching means.

19. The circuit as claimed in claim 11, wherein the voltage regulating means has a P channel MOS transistor.

20. The circuit as claimed in claim 11, wherein the low noise voltage regulating means has an N channel MOS transistor.

* * * * *

UNITED STATES PATENT AND TRADEMARK OFFICE

CERTIFICATE OF CORRECTION

PATENT NO. : 7,405,548 B2
APPLICATION NO. : 11/155321
DATED : July 29, 2008
INVENTOR(S) : Admir Alihodzic et al.

It is certified that error appears in the above-identified patent and that said Letters Patent is hereby corrected as shown below:

In the Claims:

In column 8, Claim 19, line 11, “P channel” should read --P-channel--

In column 8, Claim 20, line 13, “N channel” should read --N-channel--

Signed and Sealed this

Eighteenth Day of November, 2008

JON W. DUDAS
*Director of the United States Patent and Trademark Office*

UNITED STATES PATENT AND TRADEMARK OFFICE

CERTIFICATE OF CORRECTION

PATENT NO. : 7,405,548 B2
APPLICATION NO. : 11/155321
DATED : July 29, 2008
INVENTOR(S) : Admir Alihodzic et al.

It is certified that error appears in the above-identified patent and that said Letters Patent is hereby corrected as shown below:

On the Title Page, Item (75), please correct "Graz (AU)" to read--Graz (AT)--.

Signed and Sealed this

Seventeenth Day of March, 2009

JOHN DOLL
*Acting Director of the United States Patent and Trademark Office*